US008944349B2

(12) United States Patent
Ukigai et al.

(10) Patent No.: US 8,944,349 B2
(45) Date of Patent: Feb. 3, 2015

(54) SHOWER APPARATUS

(75) Inventors: Kiyotake Ukigai, Kitakyushu (JP); Minoru Sato, Kitakyushu (JP); Katsuya Nagata, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 400 days.

(21) Appl. No.: 13/419,300

(22) Filed: Mar. 13, 2012

(65) Prior Publication Data

US 2012/0234943 A1 Sep. 20, 2012

(30) Foreign Application Priority Data

Mar. 14, 2011 (JP) ..... 2011-055419

(51) Int. Cl.

| | |
|---|---|
| ***B05B 7/10*** | (2006.01) |
| ***E03C 1/08*** | (2006.01) |
| ***B05B 1/34*** | (2006.01) |
| ***B05B 7/04*** | (2006.01) |
| ***B05B 1/08*** | (2006.01) |
| ***B05B 1/18*** | (2006.01) |

(52) U.S. Cl.

CPC ..... *B05B 7/0425* (2013.01); *B05B 1/08* (2013.01); *B05B 1/18* (2013.01)

USPC ..... 239/428.5; 239/399; 239/403; 239/463; 239/464; 239/494; 239/496

(58) Field of Classification Search

CPC ..... B05B 1/18; B05B 7/0425; E03C 1/084

USPC ..... 239/399, 403, 428.5, 432, 463, 464, 239/491, 494, 496, 596

See application file for complete search history.

(56) References Cited

U.S. PATENT DOCUMENTS

| | | | | |
|---|---|---|---|---|
| 4,346,844 | A * | 8/1982 | Harmony | 239/381 |
| 5,143,295 | A * | 9/1992 | Okayama et al. | 239/403 |
| 7,721,979 | B2 * | 5/2010 | Mazzola | 239/533.14 |
| 2006/0163391 | A1 * | 7/2006 | Schorn | 239/596 |
| 2007/0200013 | A1 * | 8/2007 | Hsiao | 239/557 |

FOREIGN PATENT DOCUMENTS

| | | | |
|---|---|---|---|
| JP | 3747323 | B1 | 2/2006 |
| JP | 2006-509629 | A | 3/2006 |
| JP | 2008-237601 | A | 10/2009 |

* cited by examiner

*Primary Examiner* — Ryan Reis
(74) *Attorney, Agent, or Firm* — Studebaker & Brackett PC

(57) ABSTRACT

The present invention provides a shower apparatus that allows the user to have a shower stream with a voluminous feel, even when a small volume of water is discharged, and also with a stimulus sensation arising from water being discharged in a pulsating manner. A shower apparatus F1 periodically changes the volume of air taken into an aeration unit 43 by oscillating a main water stream ejected toward the aeration unit 43 from a throttle unit 42 in a direction crossing the direction of the ejection, so that the bubbly water discharged from a water discharge unit 44 creates a pulsating shower stream.

7 Claims, 10 Drawing Sheets

SHOWER APPARATUS

CROSS-REFERENCES TO RELATED APPLICATIONS

The present application relates to and claims priority from Japanese Patent Application No. 2011-055419, filed on Mar. 14, 2011, the entire disclosure of which is incorporated herein by reference.

BACKGROUND

1. Field of the Invention

The present invention relates to a shower apparatus that discharges aerated bubbly water.

2. Description of Related Art

Known examples of water discharge apparatuses include one which discharges bubbly water by aerating water using a so-called ejector effect. When the water discharge apparatus of this type is configured as a shower apparatus which distributes water flowing into the apparatus to multiple nozzle holes and discharges it therefrom, in order to aerate the shower stream to be discharged, the water flowing into the apparatus is aerated before being distributed to each nozzle hole.

An example of such a shower apparatus is proposed in Japanese Unexamined Patent Publication (Translation of International Application) No. JP2006-509629 T (hereinafter referred to as Patent Document 1). The shower apparatus described in Patent Document 1 comprises a plurality of nozzle holes provided in the front face of a disk-shaped housing shell, and is configured to distribute water flowing into the apparatus through the center of the rear face of the housing shell to the plurality of nozzle holes and discharge it from the nozzle holes. The shower apparatus is also configured to produce bubbly water by aerating water when the water has flowed into the housing shell and distribute the obtained bubbly water to the plurality of nozzle holes which are formed such that the nozzle holes are distributed over the entire front face of the disk-shaped housing shell. In the shower apparatus, a turbulence generation/expansion unit is placed in a traveling direction of the bubbly water, causing the bubbly water to collide with the turbulence generation/expansion unit to change direction and thereby spreading the bubbly water over the entire front face of the housing shell.

Another example of such a shower apparatus is proposed in Japanese Patent No. 3747323 (hereinafter referred to as Patent Document 2). In the shower apparatus described in Patent Document 2, when a faucet such as a hot and cold mixer tap is opened, water is supplied from a hose and allowed to pass through an orifice member. When the water passes through the orifice member, a decompression chamber which is provided downstream of the orifice member is maintained under reduced pressure so that air is sucked through an inner suction port, which is an opening formed in the decompression chamber, and mixed with the water. The shower apparatus described in Patent Document 2 produces bubbly water in this manner and discharges the bubbly water through a plurality of nozzle holes provided in a shower head. In this shower apparatus, the produced bubbly water proceeds to the nozzle holes by changing direction by hitting a threaded member in a partitioned pipe disposed downstream of the decompression chamber and also hitting inner walls of the shower head disposed further downstream.

Furthermore, as a shower apparatus that discharges bubbly water, Japanese Unexamined Patent Publication No. JP2008-237601 A (hereinafter referred to as Patent Document 3) proposes a shower apparatus which comprises a fine-bubble generator equipped with a gas mixing unit for mixing gas into a water supply line through which shower water flows, the fine-bubble generator being configured to break up the gas mixed into the shower water by the gas mixing unit into fine bubbles so that the shower water to be discharged from a shower water discharge unit disposed at an outlet of the water supply line contains fine bubbles with bubble diameters of 0.1 to 1000 μm. The gas mixing unit is provided with a gas mixing rate control means for controlling the mixing rate of gas in the shower water, and a gas flow control valve, which is a solenoid valve serving as the gas mixing rate control means, is installed in a gas supply channel. The gas flow control valve is connected to a control unit that controls the operation of the shower apparatus so that the degree of opening of the valve is controlled by the control unit. Control of the opening of the gas flow control valve results in control of the channel diameter of the gas supply channel and thereby makes the flow rate of gas flowing through the gas supply channel variable.

The shower apparatus described in Patent Document 2 is intended to achieve a sensation of water hitting the user intermittently, as can be seen from the description in paragraph 0015 of the document. It is considered that the term "intermittently" means that the user can experience both strong and weak showers, which vary intermittently, by being hit by finely divided water droplets of non-uniform sizes, in which large-sized water droplets give the user a sensation of having a strong shower stream and small-sized water droplets give the user a sensation of having a weak shower stream. According to substantive studies conducted by the present inventors, it is presumed that immediately after the bubbly water is produced, air is mixed into the bubbly water substantially uniformly; whereas, when the bubbly water reaches the nozzle holes, the bubble diameters are non-uniform since the bubbles collide with each other as the produced bubbly water changes direction by hitting the threaded member or the inner walls of the shower head. When such bubbly water is discharged from the nozzle holes, it turns into water droplets of non-uniform sizes, and it is considered that the sensation described above can be achieved by directing such water droplets at the user.

Although Patent Document 1 does not have descriptions regarding the properties of the bubbly water discharged from the shower apparatus described in Patent Document 1, it is presumed that the shower apparatus supplies bubbly water with non-uniform bubble diameters to the nozzle holes to discharge it therefrom, thereby producing water droplets of non-uniform sizes and directing them at the user, as in the case of the shower apparatus described in Patent Document 2. Since the shower apparatus described in Patent Document 1 is provided with the turbulence generation/expansion unit arranged in the traveling direction of the bubbly water, to cause the bubbly water to change direction by colliding with the turbulence generation/expansion unit, it can be considered that similar non-uniform bubble growth also takes place in the shower apparatus described in Patent Document 1 and that the resulting water droplets of non-uniform sizes are directed at the user. Since both the shower apparatus described in Patent Document 1 and the shower apparatus described in Patent Document 2 give the user water droplets of non-uniform sizes which are formed from bubbly water containing non-uniform bubbles, they produce only a small difference between the strong and weak shower streams, and a sufficient stimulus sensation is thus not available.

On the other hand, in the shower apparatus described in Patent Document 3, the gas flow control valve, being the solenoid valve serving as the gas mixing rate control means, is installed in the gas supply channel, and the gas mixing rate control means allows intentional control of the bubble content; however, it becomes necessary to have the solenoid valve acting as the gas flow control valve. In other words, although the shower apparatus described in Patent Document 3 may be able to discharge bubbly water with a stimulus sensation, a means of physically operating a structure, such as a solenoid valve, is required, resulting in a water discharge apparatus which runs counter to size and cost reductions.

Under these circumstances, the present inventors conceived of providing a shower apparatus capable of providing a shower stream with a voluminous feel even when discharging a small volume of water, and also with a comfortable stimulus sensation arising from a large change in the instantaneous flow rate of the shower stream, and which also contributes to size and cost reductions. The above-described conventional techniques, which give the user a feeling of being hit by non-uniformly-sized water droplets, do not provide a shower stream with both a voluminous feel and a comfortable stimulus sensation such that the instantaneous flow rate of the shower stream is greatly changed. Further, the conventional techniques are not able to achieve size and cost reductions while providing a shower stream with both a voluminous feel and a comfortable stimulus sensation such that the instantaneous flow rate of the discharged water is greatly changed.

SUMMARY

The present invention has been made in view of the above problems, and has an object of providing a shower apparatus that allows the user to have a shower stream with a voluminous feel even when a small volume of water is discharged and also with a comfortable stimulus sensation arising from a large change in the instantaneous flow rate of the shower stream.

To solve the above problems, the present invention provides a shower apparatus that discharges aerated bubbly water, comprising: a water supply unit that supplies water; a throttle unit disposed downstream of the water supply unit, the throttle unit making a cross sectional area of a flow channel smaller than that of the water supply unit and thereby increasing a flow velocity of water passing through the throttle unit to eject the water downstream as a main water stream; an aeration unit disposed downstream of the throttle unit and provided with an opening for aerating the main water stream to produce bubbly water; and a water discharge unit disposed downstream of the aeration unit and provided with a plurality of nozzle holes for discharging the bubbly water. The shower apparatus according to the present invention further comprises a side-water-stream producing unit that produces a side water stream traveling in a direction different from that of the main water stream. By the effect of the side water stream, the shower apparatus according to the present invention periodically changes the traveling direction of the main water stream, thereby changing the volume of air mixed into the main water stream in the aeration unit.

According to the present invention, since the aeration unit produces the bubbly water by aerating the main water stream ejected from the throttle unit and the obtained bubbly water is discharged from the water discharge unit, the user can enjoy a shower stream with a voluminous feel. Furthermore, since the shower apparatus is provided with the side-water-stream producing unit which produces a side water stream traveling in a different direction from that of the main water stream and since the traveling direction of the main water stream is periodically changed by the effect of the side water stream, the volume of air mixed into the main water stream in the aeration unit can be changed. As a result of this change in volume of the mixed air, the instantaneous flow rate of the bubbly water discharged from the water discharge unit varies greatly, which makes the water stream hitting the user include both a strong stream and a weak stream. When the ratio of the mixed air is low, the instantaneous flow rate of the bubbly water is high and the user thus feels as if he/she has been hit by a strong water stream; whereas, when the ratio of the mixed air is high, the instantaneous flow rate of the bubbly water is low and the user thus feels as if he/she has been hit by a weak water stream. When the user experiences a strong water stream and a weak water stream in this way, the user can enjoy a pulsating stimulus.

According to the present invention, a shower stream with a pulsating stimulus, as described above, is obtained by producing a side water stream in such a manner as to periodically change the traveling direction of the main water stream. In other words, the present invention provides a shower apparatus that can give the user a comfortable stimulus in a simple configuration, without a separately installed means, such as a pump for changing the pressure of the shower stream in a pulsating manner.

In the shower apparatus according to the present invention, the side-water-stream producing unit preferably produces the side water stream such that side-water-stream negative pressure is generated in the vicinity of the main water stream.

When changing the traveling direction of the main water stream by using the side water stream, a preferable way is to create a variation in pressure arising from the side water stream in the vicinity of the main water stream. In the present invention, the bubbly water is produced by taking in air through the opening of the aeration unit as described above, and thus, the aeration unit has negative pressure inside. In the preferred aspect of the invention described above, in order not to reduce the negative pressure in the aeration unit, the traveling direction of the main water stream is changed periodically by generating side-water-stream negative pressure in the vicinity of the main water stream.

In the shower apparatus according to the present invention, it is also preferable that the traveling direction of the main water stream is periodically changed by a difference in pressure between the side-water-stream negative pressure and negative suction pressure which is generated to take in air from the opening to the aeration unit, and that the side-water-stream producing unit changes the side-water-stream negative pressure by the effect of the side water stream and thereby changes the difference in pressure.

When considering merely changing the traveling direction of the main water stream, the only thing required is to generate negative pressure acting in a direction crossing the traveling direction of the main water stream, and it may be possible to change the traveling direction of the main water stream merely by changing the negative suction pressure which is generated when taking in air from the opening to produce the bubbly water. However, when changing the traveling direction of the main water stream only by the effect of the negative suction pressure, the negative suction pressure may be balanced with the pressure of the main water stream after the change due to the negative suction pressure and this may stop the flow of the main water stream. In the preferred aspect of the invention described above, the traveling direction of the main water stream is periodically changed by the pressure difference between the negative suction pressure and the side-water-stream negative pressure and, as a result, both the negative suction pressure and the side-water-stream negative pressure act on the main water stream and it is possible to prevent the main water stream from stopping traveling due to the pressure being balanced. Since the traveling direction of the main water stream is changed by a change in the pressure of the side water stream in this preferred aspect of the invention, it is possible to ensure that the traveling direction of the main water stream is periodically changed in a simpler configuration.

In the shower apparatus according to the present invention, it is also preferable that the side-water-stream producing unit produces the side water stream such that the side-water-stream negative pressure is increased when the negative suction pressure is reduced, and the side-water-stream negative pressure is reduced when the negative suction pressure is increased.

In the preferred aspect of the invention described above, by increasing the side-water-stream negative pressure when the negative suction pressure is reduced and reducing the side-water-stream negative pressure when the negative suction pressure is increased, a large force can be applied to the main water stream alternately from the negative suction pressure and from the side-water-stream negative pressure. As a result, changes in the traveling direction of the main water stream can be further ensured.

In the shower apparatus according to the present invention, it is also preferable that the side-water-stream producing unit produces the side water stream using the main water stream ejected toward the aeration unit.

In the preferred aspect of the invention described above, since the side water stream is produced from the main water stream, the traveling direction of the main water stream can be periodically changed in a simpler configuration without separately providing a particular mechanism for producing the side water stream.

In the shower apparatus according to the present invention, it is also preferable that the side-water-stream producing unit has a swirl chamber serving as a guide to produce the side water stream as a swirled stream.

In the preferred aspect of the invention described above, the swirl chamber is provided as a guide to produce the side water stream, and the swirled stream which forms the side water stream can be increased and decreased by changing the size of the swirl chamber. Accordingly, by controlling the size of the swirl chamber depending on the required magnitude of the side-water-stream negative pressure to be generated by the side water stream, suitable side-water-stream negative pressure can be generated.

In the shower apparatus according to the present invention, it is also preferable that the swirl chamber is located such that the swirl chamber and the opening are on opposite sides of the main water stream and facing each other.

In the preferred aspect of the invention described above, since the swirl chamber generating the side-water-stream negative pressure and the opening generating the negative suction pressure are located so as to face each other, the side-water-stream negative pressure and the negative suction pressure can be generated on opposite sides of the main water stream, which enables the traveling direction of the main water stream to be periodically changed in a stable manner.

In the shower apparatus according to the present invention, it is also preferable that the swirl chamber is disposed at an end of the aeration unit close to the throttle unit.

In the present invention, the end of the aeration unit close to the throttle unit indicates the part of the aeration unit closest to the location where the main water stream is ejected and indicates the part where the flow velocity of the main water stream is fastest. In the preferred aspect of the invention described above, the swirl chamber is disposed at the location having the fastest flow velocity of the main water stream, and the resulting swirled stream also becomes faster, which enables greater side-water-stream negative pressure to be generated.

In the shower apparatus according to the present invention, it is also preferable that the throttle unit ejects the main water stream in a direction which is inclined toward the opening and away from the location where the side water stream is produced.

In the preferred aspect of the invention described above, the direction of ejecting the main water stream is inclined toward the opening, and the traveling direction of the main water stream ejected from the throttle unit is thus inclined toward the opening. Since a side water stream is produced as a result of the ejection of the main water stream and side-water-stream negative pressure is generated accordingly, the traveling direction of the main water stream which is originally inclined toward the opening will be changed to instead be inclined toward the side water stream. By attracting the main water stream, which was originally inclined toward the opening, to travel in a direction inclined toward the side water stream, the extent of change in the traveling direction of the main water stream can be increased, enabling the volume of the mixed air to be greatly changed. As a result, the user can experience a water stream which changes greatly between strong and weak water streams, and can thus enjoy a strongly pulsating stimulus.

In the shower apparatus according to the present invention, it is also preferable that the main water stream is produced as a water stream that prevents the air taken in from the opening from flowing into the side water stream.

In the preferred aspect of the invention described above, since the main water stream prevents the air taken in from the opening from flowing into the side water stream, the side water stream can be produced in a more stable manner and the side-water-stream negative pressure can thus be generated in a more stable manner.

The present invention can provide a water discharge apparatus that allows the user to have a shower stream with a voluminous feel even when a small volume of water is discharged and also with a comfortable stimulus sensation arising from a large change in the instantaneous flow rate of the shower stream.

BRIEF DESCRIPTION OF THE DRAWINGS

FIGS. 1A to 1C are diagrams showing a shower apparatus according to an embodiment of the present invention, in which FIG. 1A is a plan view, FIG. 1B is a side view, and FIG. 1C is a bottom view.

DETAILED DESCRIPTION OF PREFERRED EMBODIMENTS

Figure 1A:
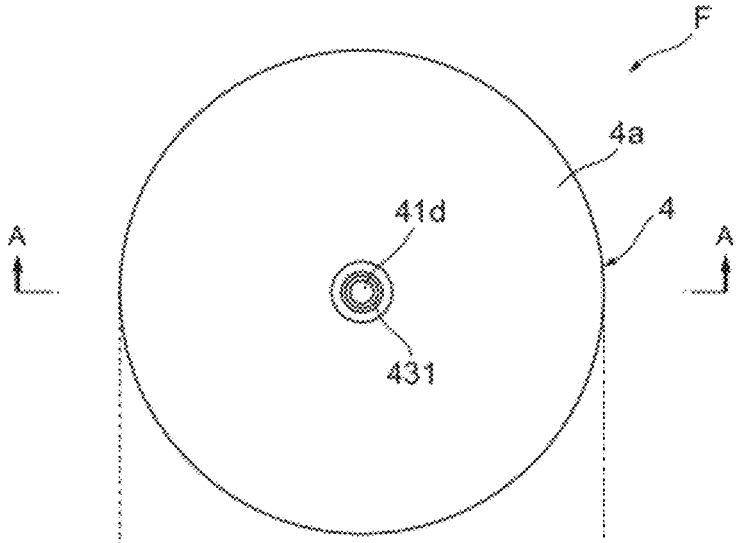

Embodiments of the present invention will be described below with reference to the accompanying drawings. To facilitate understanding of the description, the same components in different drawings are denoted by the same reference numerals whenever possible and repetitive description thereof will be omitted.

Figure 1B:
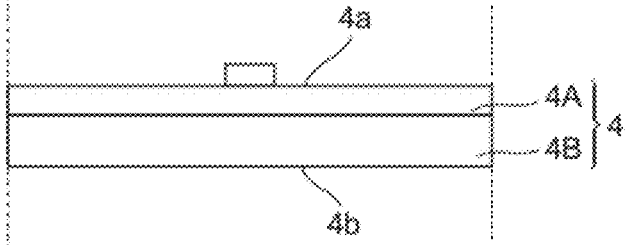
Figure 1C:
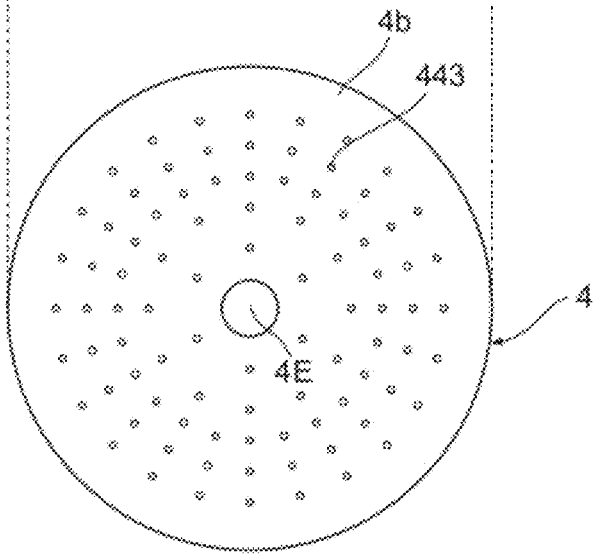

A shower apparatus, which is an embodiment of the present invention, will be described with reference to FIGS. 1A to 1C, which are diagrams showing a shower apparatus F1 according to an embodiment of the present invention, in which FIG. 1A is a plan view, FIG. 1B is a side view, and FIG. 1C is a bottom view. As shown in FIG. 1A, the shower apparatus F1 has, as a major component, a body 4 which is approximately disk-shaped, and a water supply port 41*d* and an opening 431 are formed in a top face 4*a* of the shower apparatus F1 (body 4).

As shown in FIG. 1B, the body 4 of the shower apparatus F1 has an external shape formed of: a cavity plate 4A in which the water supply port 41*d* and the opening 431 are formed; and a shower plate 4B in which nozzle holes 443 are formed. As shown in FIG. 1C, the nozzle holes 443 are formed in a bottom face 4*b* of the body 4, and a sealing piece 4E is disposed in the bottom face 4*b*. In this embodiment, the nozzle holes 443 are arranged radially around the sealing piece 4E.

Figure 2:
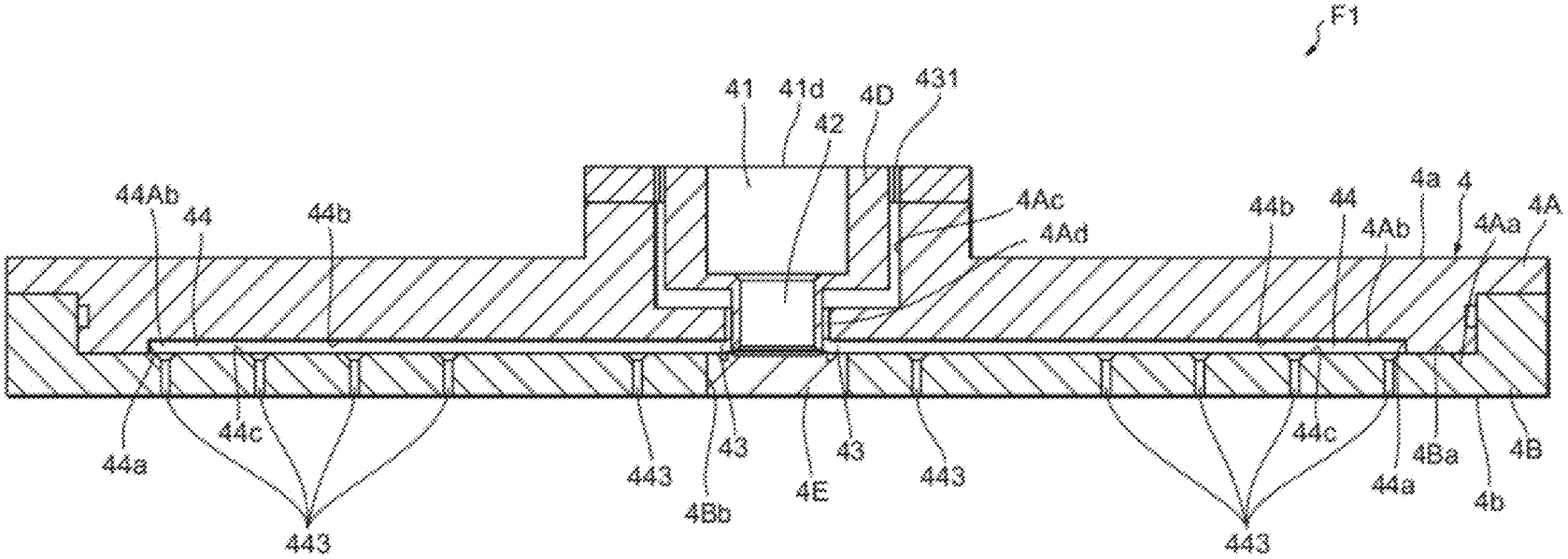
FIG. 2 is a sectional view taken along line A-A in FIG. 1A.

Next, the shower apparatus F1 will be described with reference to FIG. 2, which is a sectional view taken along line A-A in FIG. 1A. As shown in FIG. 2, the shower apparatus F1 is comprised of the cavity plate 4A, the shower plate 4B, an introduction piece 4D and the sealing piece 4E.

The cavity plate 4A is a member which forms the external shape of the body 4 together with the shower plate 4B. In the cavity plate 4A, a concave portion 4Ab, circular in shape, is formed in a contact surface 4Aa, which is a surface of the cavity plate 4A on the side opposite to the top face 4*a* of the body 4, so as to extend toward the top face 4*a*.

The shower plate 4B is a member which forms the external shape of the body 4 together with the cavity plate 4A, and a plurality of nozzle holes 443 is arranged radially in the shower plate 4B. In the region in which the nozzle holes 443 are formed, a contact surface 4Ba, which is a surface of the shower plate 4B on the side opposite to the bottom face 4*b*, is configured to serve as a side wall 44*c* of a water discharge unit 44.

When contacting the contact surface 4Ba of the shower plate 4B and the contact surface 4Aa of the cavity plate 4A with each other, a space is formed by the contact surface 4Ba and the concave portion 4Ab of the cavity plate 4A, the space being configured to serve as an aeration unit 43 and the water discharge unit 44. A part of the concave portion 4Ab is configured to serve as a side wall 44*a* of the water discharge unit 44.

Figure 3:
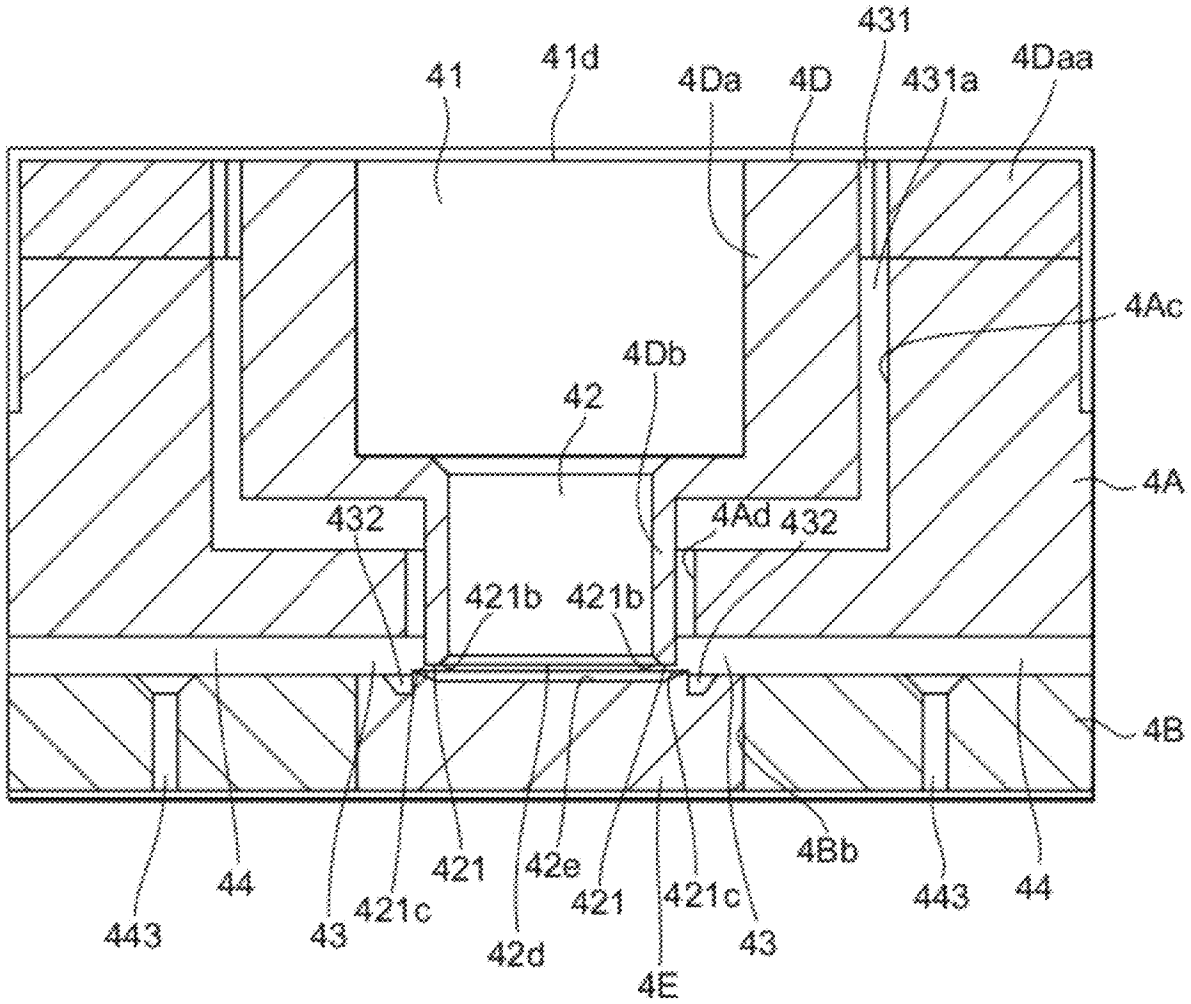
FIG. 3 is an enlarged perspective sectional view magnifying and showing the aeration unit shown in FIG. 2 and its vicinity.

Next, a water supply unit 41, a throttle unit 42 and the aeration unit 43 of the shower apparatus F1 will be described with reference to FIG. 3, which enlarges those units and their vicinity. As shown in FIG. 3, the water supply unit 41, the throttle unit 42 and the aeration unit 43 are constituted by the cavity plate 4A, the shower plate 4B, the introduction piece 4D and the sealing piece 4E.

The introduction piece 4D has a large-diameter portion 4Da and a small-diameter portion 4Db. The water supply port 41*d* is formed at an end of the large-diameter portion 4Da on the side opposite to the small-diameter portion 4Db. The large-diameter portion 4Da has a cylindrical space formed therein to communicate with the water supply port 41*d*, and this space serves as the water supply unit 41. At the end of the large-diameter portion 4Da where the water supply port 41*d* is formed, a flange 4Daa is formed. The opening 431 is formed in the flange 4Daa to extend through the flange 4Daa in the thickness direction.

At an end of the small-diameter portion 4Db on the side opposite to the large-diameter portion 4Da, a throttle port 42*b* is formed. The small-diameter portion 4Db has a space formed therein to provide communication between the throttle port 42*b* and the water supply unit 41, and this space serves as the throttle unit 42.

The introduction piece 4D is housed in a concave portion 4Ac and a through-hole 4Ad, which are formed in the cavity plate 4A. The concave portion 4Ac is formed at the center of the cavity plate 4A, and the through-hole 4Ad is formed at the bottom center of the concave portion 4Ac. The small-diameter portion 4Db of the introduction piece 4D is housed in the through-hole 4Ad and arranged to protrude from the through-hole 4Ad and face the sealing piece 4E. The large-diameter portion 4Da of the introduction piece 4D is housed in the concave portion 4Ac and the flange 4Daa comes into contact with an outer edge of the concave portion 4Ac.

A space is formed between the large-diameter portion 4Da and the concave portion 4Ac and between the small-diameter portion 4Db and the through-hole 4Ad, and serves as an air channel 431*a*. The air channel 431*a* is formed to allow communication between the opening 431 and the aeration unit 43.

The sealing piece 4E is engaged in a through-hole 4Bb formed at the center of the shower plate 4B. At the center of a surface of the sealing piece 4E on the side close to the introduction piece 4D, a water-guiding concave portion 42*e* is formed, and a swirl chamber 432 is formed around the water-guiding concave portion 42*e*. Each of the water-guiding concave portion 42*e* and the swirl chamber 432 is formed as a concave portion formed in the surface of the sealing piece 4E on the side close to the introduction piece 4D.

The water-guiding concave portion 42*e* has a slope 421*c* formed at an edge thereof close to the swirl chamber 432. The slope 421*c* is formed as a gradually ascending slope extending from the bottom of the water-guiding concave portion 42*e*. The slope 421*c* is arranged such that it faces an end surface 421*b* of the small-diameter portion 4Db of the introduction piece 4D, and the end surface 421*b* is disposed to be parallel to the bottom surface of the water-guiding concave portion 42*e*. The slope 421*c* and the end surface 421*b* define a throttle channel 421.

Water introduced from the water supply port 41*d* passes through the water supply unit 41 and the throttle unit 42, and is ejected through the throttle channel 421 toward the aeration unit 43. Meanwhile, air introduced from the opening 431 passes through the air channel 431*a* and is introduced to the aeration unit 43. When water is ejected through the throttle channel 421 toward the aeration unit 43, a gas-liquid interface is formed on a side close to the water discharge unit 44 and the ejected water enters the gas-liquid interface to take in air. As a result, bubbly water is produced.

As described above, the shower apparatus F1 is constructed by assembling the cavity plate 4A, the shower plate 4B, the introduction piece 4D and the sealing piece 4E, such that the shower apparatus F1 includes the water supply unit 41, the throttle unit 42, the aeration unit 43 and the water discharge unit 44.

The water supply unit 41 is a unit for supplying water, and it supplies water introduced from the water supply port 41*d* to the throttle unit 42. Although not shown in the drawings, a water supply means (e.g., a water supply hose) can be connected to the water supply port 41*d*, and the water supply unit 41 supplies water which has been provided through the water supply means to the throttle unit 42.

The throttle unit 42 is disposed downstream of the water supply unit 41 and makes the cross sectional area of the flow channel smaller than that in the water supply unit 41, thereby ejecting water passing through the throttle unit downstream. The throttle channel 421 is formed in the throttle unit 42.

The aeration unit 43 is disposed downstream of the throttle unit 42, and has the opening 431 and the air channel 431*a* formed therein to produce bubbly water by aerating water ejected through the throttle unit 42.

The water discharge unit 44 is disposed downstream of the aeration unit 43, and has a plurality of nozzle holes 443 formed therein to discharge the bubbly water.

In the shower apparatus F1, the traveling direction of the water ejected through the throttle channel 421 is changed periodically in the aeration unit 43, so as to change the ratio of the mixed air in the bubbly water periodically. This periodic change in the mixed air ratio enables the water to be discharged in a pulsating manner and gives the user a stimulus sensation.

Figure 4:
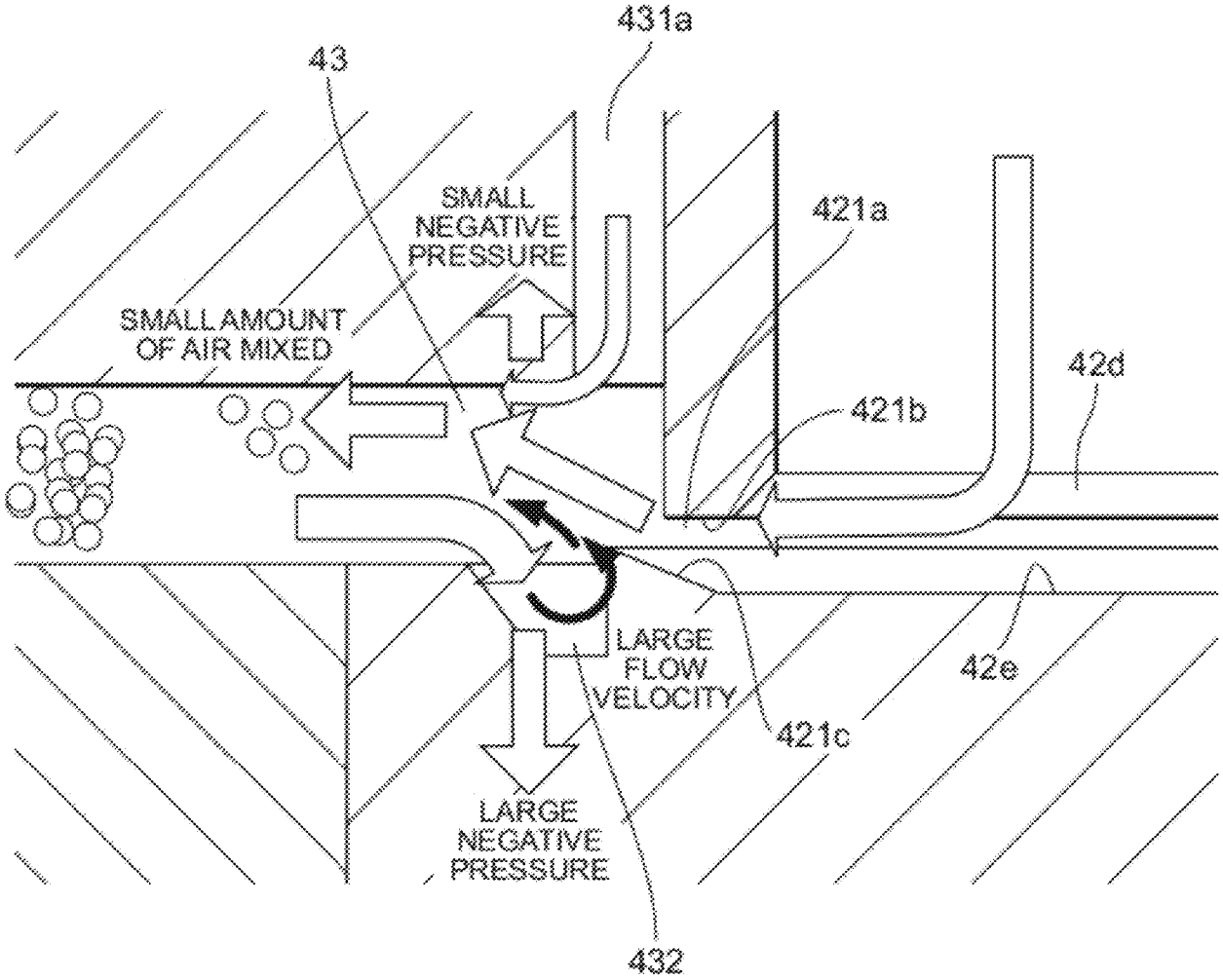
FIG. 4 is a diagram explaining the mechanism of discharging water in a pulsating manner in the shower apparatus of the embodiment.
Figure 5:
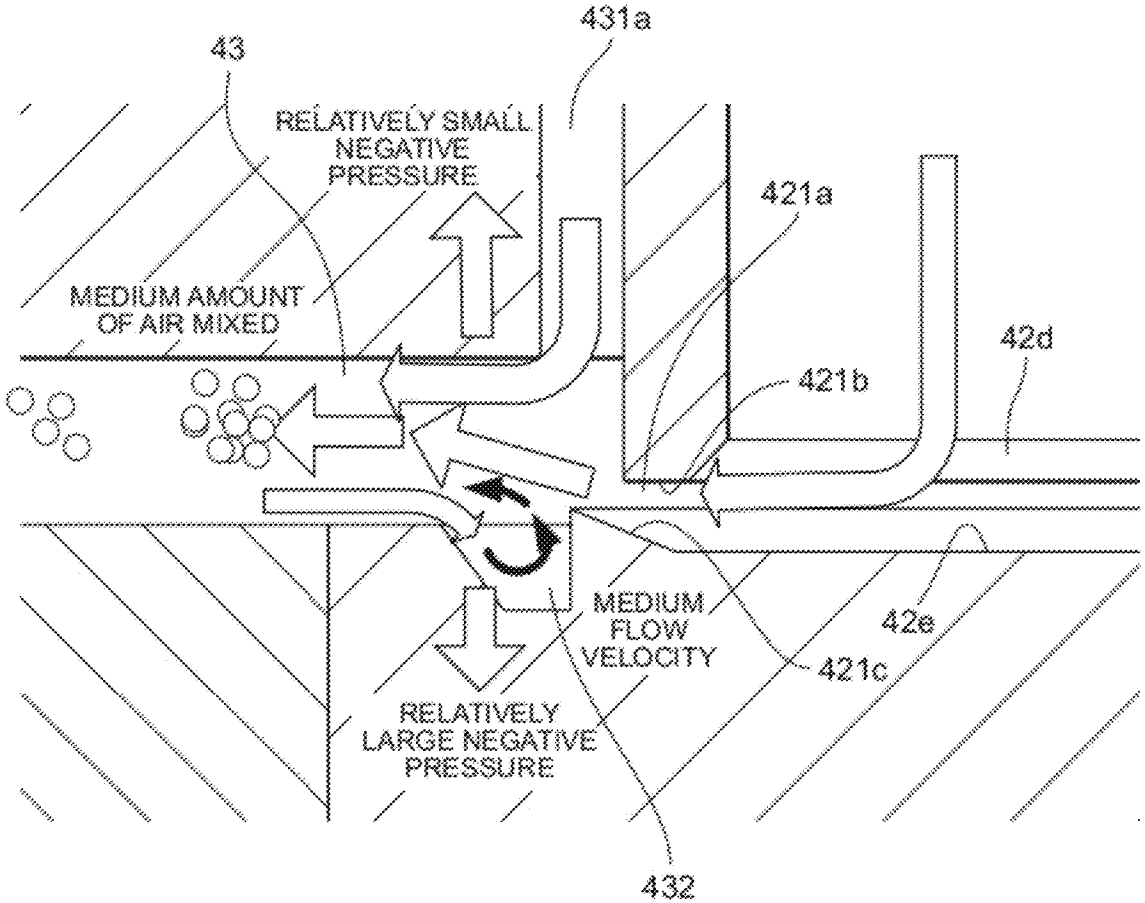
FIG. 5 is a diagram explaining the mechanism of discharging water in a pulsating manner in the shower apparatus of the embodiment.
Figure 6:
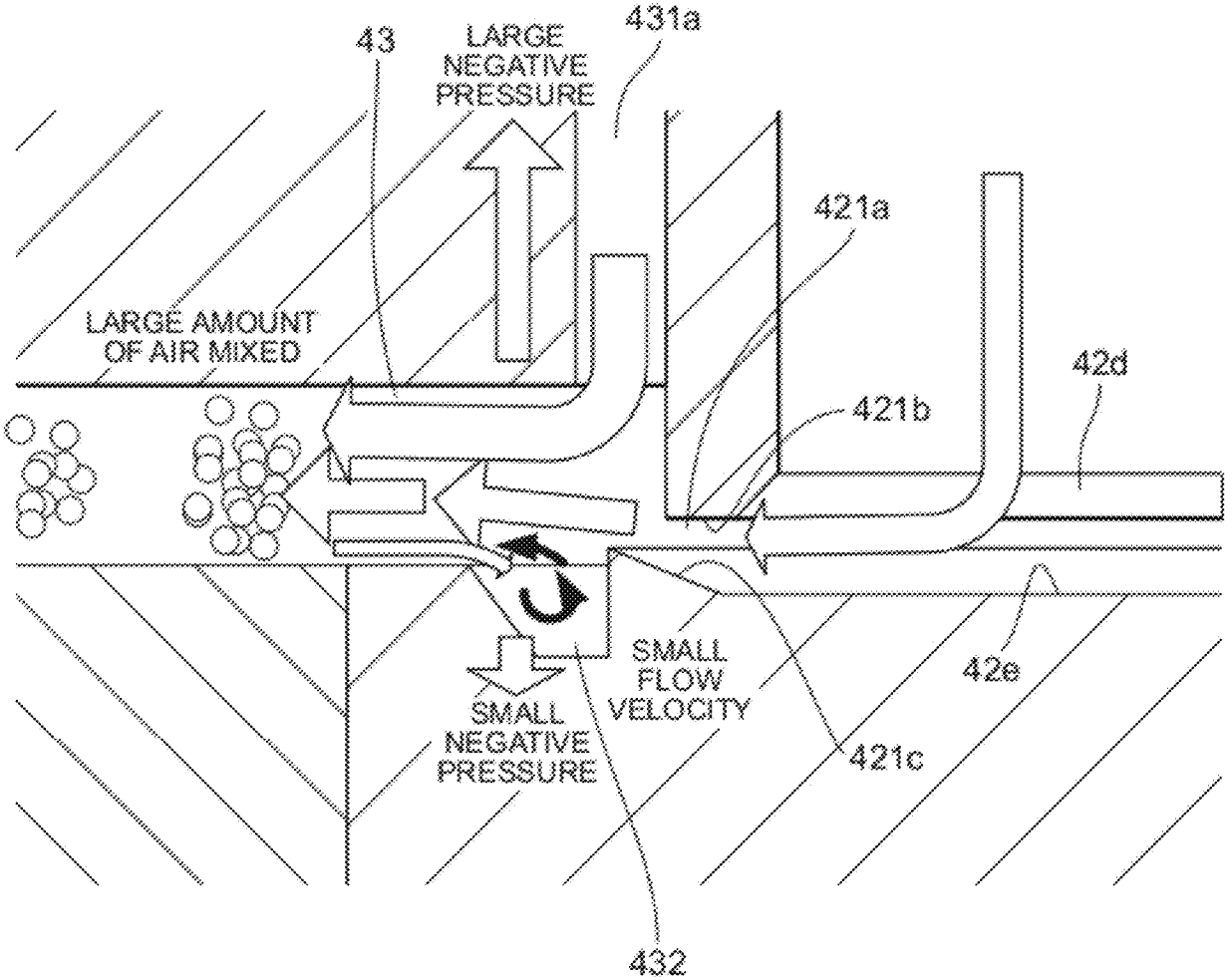
FIG. 6 is a diagram explaining the mechanism of discharging water in a pulsating manner in the shower apparatus of the embodiment.
Figure 7:
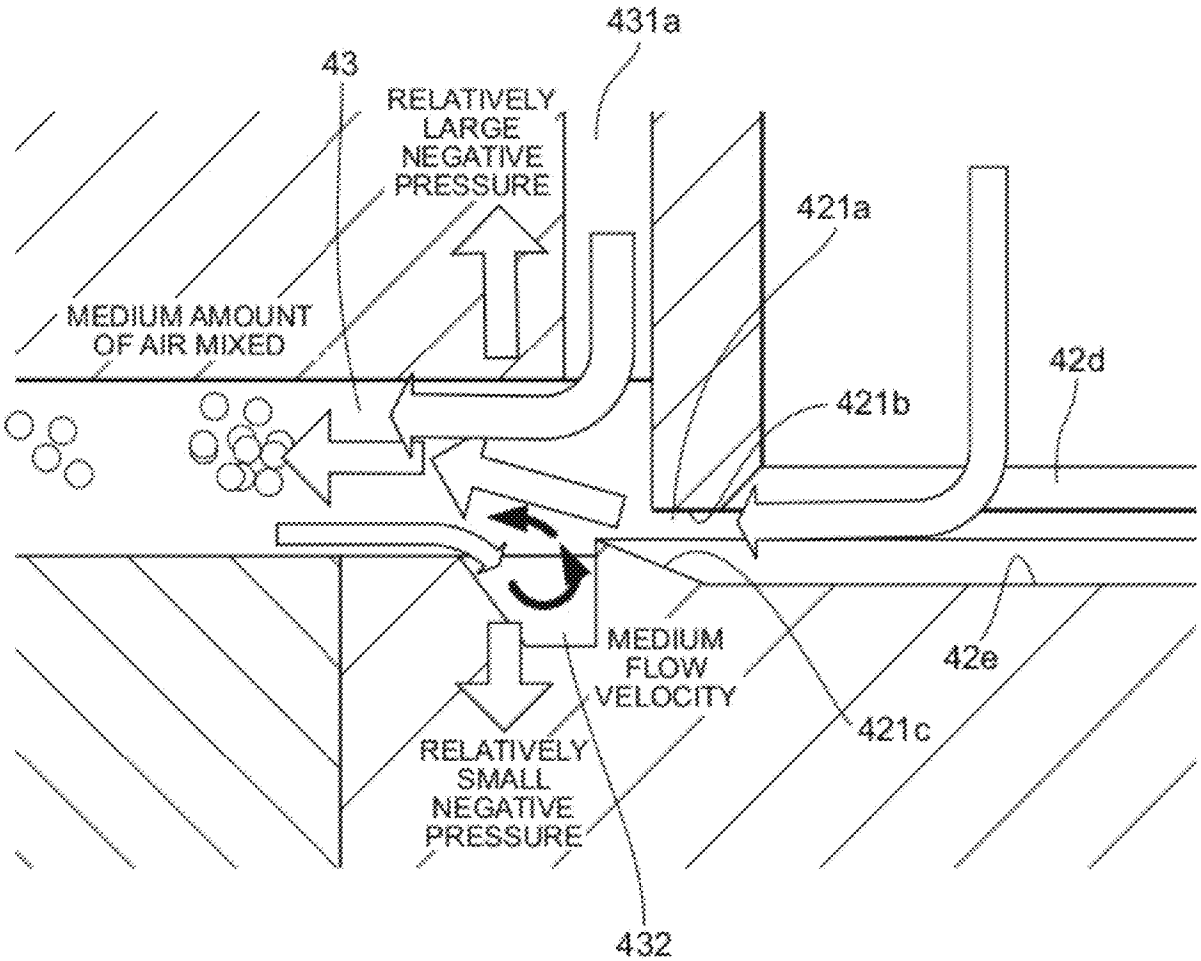
FIG. 7 is a diagram explaining the mechanism of discharging water in a pulsating manner in the shower apparatus of the embodiment.

Next, the mechanism of changing the mixed air ratio periodically will be described with reference to FIGS. 4-7, which are enlarged views of the throttle channel 421, and its vicinity, and which illustrate how the mixed air ratio changes over time. FIG. 4 shows an initial state in which water starts to be ejected through the throttle channel 421. FIG. 5 shows a state in which the mixed air ratio has been increased relative to the state shown in FIG. 4. FIG. 6 shows a state in which the mixed air ratio has been further increased relative to the state shown in FIG. 5, so as to be the maximum value. FIG. 7 shows a state in which the mixed air ratio has been decreased relative to the state shown in FIG. 6.

First, as can be seen from FIG. 4, the water ejected through the throttle channel 421 travels along the slope 421*c* toward the air channel 431*a*, which is shown in the upper part of the drawing, to form a main water stream. Negative pressure is generated by the effect of the main water stream ejected through the throttle channel 421, resulting in air being taken in from the opening 431 through the air channel 431*a*. As a result of the main water stream being ejected through the throttle channel 421, the aeration unit 43 is filled with water. Since a difference in velocity exists between the main water stream ejected through the throttle channel 421 and the water flowing near the walls and the swirl chamber 432 is relatively distant from the traveling direction of the main water stream, part of the water ejected through the throttle channel 421 returns and is directed to the swirl chamber 432. The water directed to the swirl chamber 432 forms a swirled side water stream.

The flow of air passing through the air channel 431*a* and the swirled side water stream in the vicinity of the swirl chamber 432 occur in parallel as described above, and they generate negative suction pressure and side-water-stream negative pressure, respectively, to sandwich the main water stream. In the state shown in FIG. 4, since the main water stream is close to the air channel 431*a* (the opening 431), the side water stream is generated so as to form a large swirl. As a result, the side-water-stream negative pressure is larger than the negative suction pressure, and accordingly, the mixed air ratio is low (the volume of the mixed air is small) and the main water stream is attracted toward the swirl chamber 432.

Next, as can be seen from FIG. 5, the main water stream formed of the water ejected through the throttle channel 421 changes its direction toward the swirl chamber 432. In the state shown in FIG. 5, the main water stream is directed away from the air channel 431*a*, which allows a larger space for the air introduced through the air channel 431*a*, resulting in a larger volume of air being introduced in the aeration unit 43. Meanwhile, since the main water stream becomes close to the swirl chamber 432, the side water stream is generated to form a small swirl, and accordingly, the negative suction pressure is larger than the side-water-stream negative pressure. As a result, the mixed air ratio is increased to a middle level and the volume of the mixed air is also increased to a mid-level. Although the negative suction pressure has, at this stage, become larger than the side-water-stream negative pressure, due to inertia acting to cause the main water stream to change its direction toward the swirl chamber 432 as in the state shown in FIG. 4, the main water stream continues to change its direction toward the swirl chamber 432.

Next, as can be seen from FIG. 6, the traveling direction of the main water stream formed of the water ejected through the throttle channel 421 becomes the closest to the swirl chamber 432. In other words, the main water stream is directed the furthest away from the air channel 431*a* in the state shown in FIG. 6, and the space for the air introduced through the air channel 431*a* thus becomes the largest, allowing further more air to be introduced into the aeration unit 43. Meanwhile, since the main water stream becomes the closest to the swirl chamber 432, the side water stream is generated to form a further smaller swirl. As a result, the negative suction pressure is much larger than the side-water-stream negative pressure, which increases the mixed air ratio to the highest level and also increases the volume of the mixed air to the highest level. Now that the negative suction pressure is substantially larger than the side-water-stream negative pressure, the main water stream is then attracted toward the air channel 431*a*.

Next, as can be seen from FIG. 7, the main water stream formed of the water ejected through the throttle channel 421 changes its direction away from the swirl chamber 432 toward the air channel 431*a*. In the state shown in FIG. 7, the main water stream becomes close to the air channel 431*a*, which makes the space for the air introduced through the air channel 431*a* smaller than that in the state shown in FIG. 6 (but larger than in the state shown in FIG. 5), and as a result, the amount of air introduced in the aeration unit 43 reaches a middle level. Meanwhile, since the main water stream is distant from the swirl chamber 432, the side water stream is now generated to form a large swirl. As a result, the negative suction pressure becomes smaller than the side-water-stream negative pressure, and accordingly, the mixed air ratio is reduced to a middle level and the volume of the mixed air is also reduced to a middle level. Although the negative suction pressure has, at this stage, become smaller than the side-water-stream negative pressure, due to inertia acting to cause the main water stream to change its direction toward the air channel 431*a*, as in the state shown in FIG. 6, the main water stream continues to change its direction toward the air channel 431*a*. When the state shown in FIG. 7 proceeds further, the state shown in FIG. 4 appears again, and the cycle of the above-described states is repeated.

Figure 8:
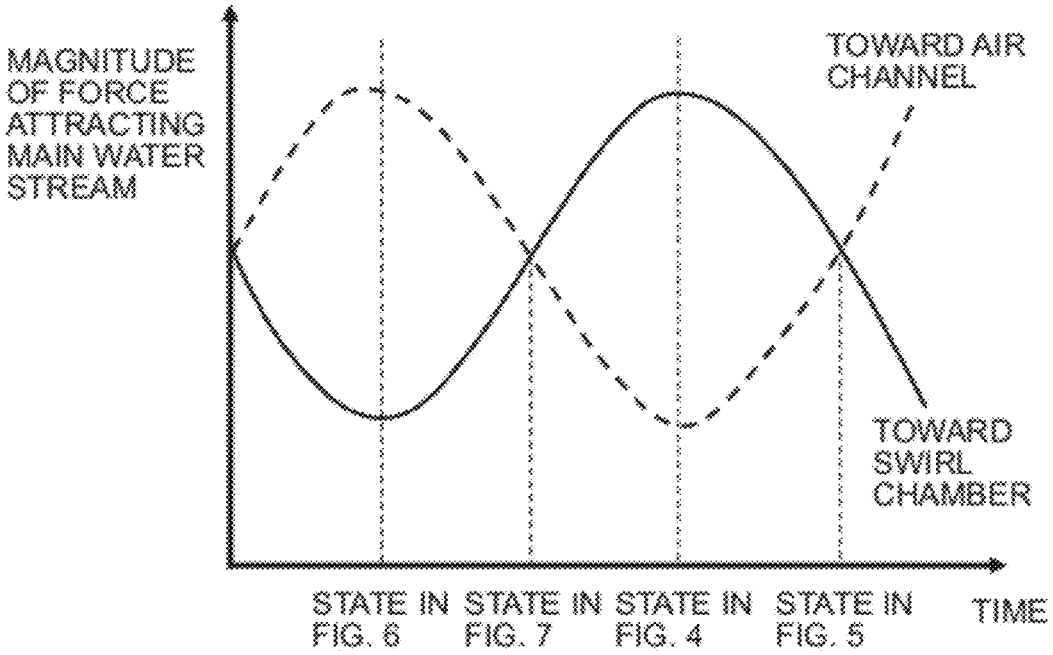
FIG. 8 is a diagram explaining the mechanism of discharging water in a pulsating manner in the shower apparatus of the embodiment.

With the above-described mechanism, the negative suction pressure and the side-water-stream negative pressure create oscillations having opposite phases to each other in a repeated manner. In order to demonstrate the relationship between the negative suction pressure and the side-water-stream negative pressure, FIG. 8 shows the chronological changes of the magnitude of force to attract the main water stream. As shown in FIG. 8, if the force to attract the main water stream toward the swirl chamber 432 is the smallest, the force to attract the main water stream toward the air channel 431*a* becomes the largest (see FIG. 6). On the other hand, if the force to attract the main water stream toward the swirl chamber 432 is the largest, the force to attract the main water stream toward the air channel 431*a* becomes the smallest (see FIG. 6). The force to attract the main water stream toward the swirl chamber 432 and the force to attract the main water stream toward the air channel 431*a* can instantaneously be balanced (see FIGS. 5 and 7); however, the force to attract the main water stream toward the swirl chamber 432 continues decreasing while the force to attract it toward the air channel 431*a* continues increasing (see FIG. 5), or the force to attract the main water stream toward the swirl chamber 432 continues increasing while the force to attract it toward the air channel 431*a* continues decreasing (see FIG. 7), and accordingly, the main water stream continues changing its traveling direction.

Figure 9A:
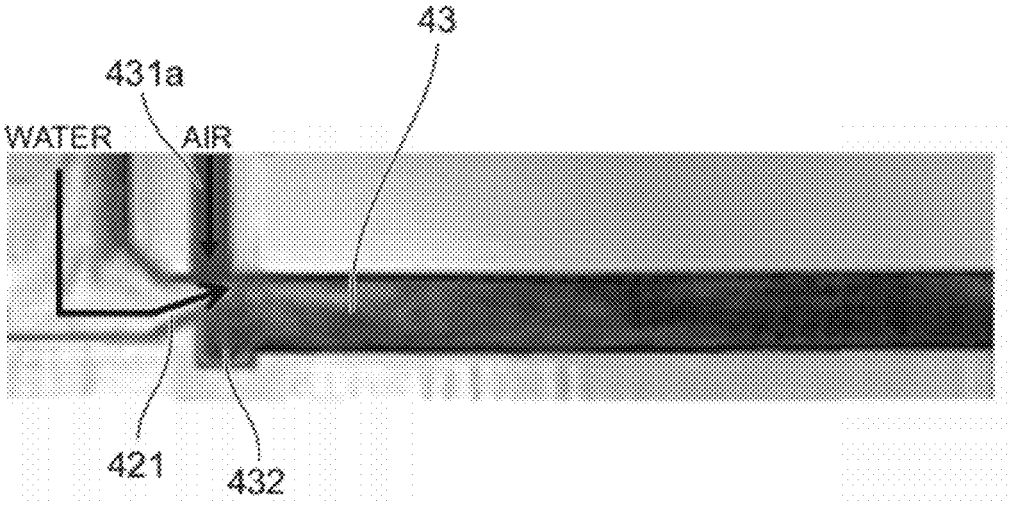
FIGS. 9A and 9B are pictures showing the mechanism of discharging water in a pulsating manner in the shower apparatus of the embodiment.
Figure 9B:
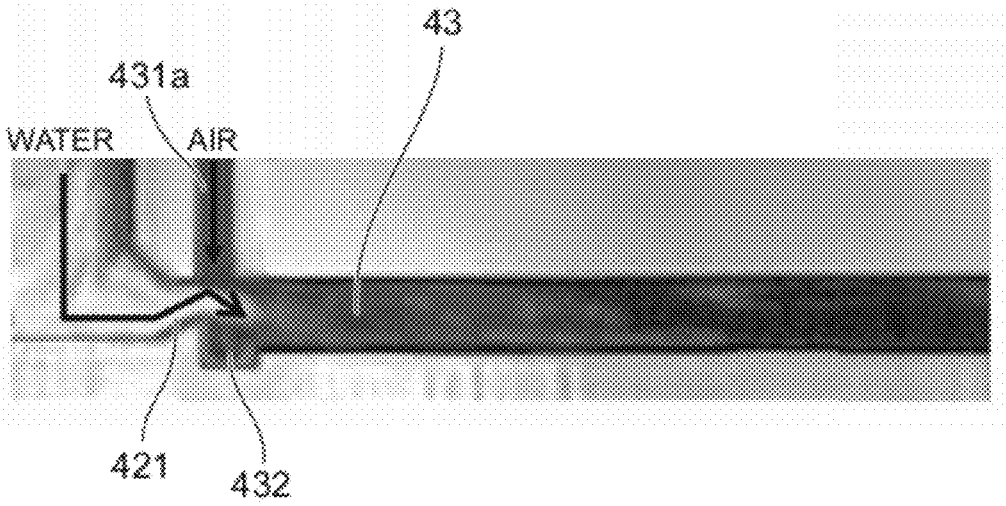

FIGS. 9A and 9B are pictures of the shower apparatus F1 configured based on the above-described mechanism, each showing the internal state of the apparatus when water is allowed to pass through the apparatus. FIG. 9A is a picture showing a state when water is actually allowed to pass through the shower apparatus in the state described above referring to FIG. 4, and FIG. 9B is a picture showing a state when water is actually allowed to pass through the shower apparatus in the state described above referring to FIG. 6.

Figures 10A, 10B, 10C:
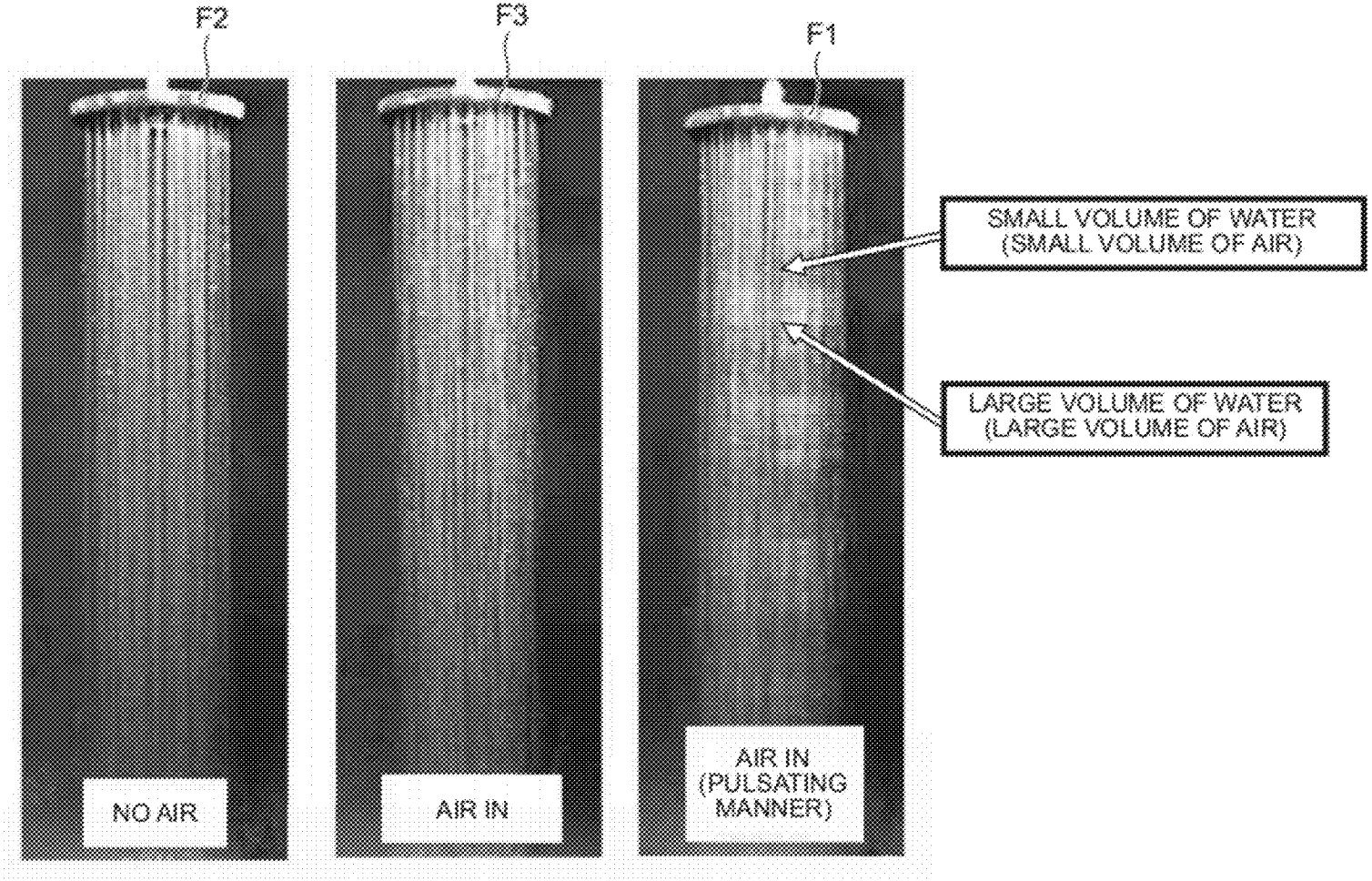
FIGS. 10A, 10B, 10C are pictures explaining a state where water is discharged in a pulsating manner in the shower apparatus of the embodiment.

FIGS. 10A, 10B, and 10C are pictures of a state where water is discharged from the shower apparatus F1 configured based on the above-described mechanism. As can be seen from FIG. 10C, when water is discharged from the shower apparatus F1, the obtained shower stream is a pulsating stream including a less aerated stream with a large volume of water and a more aerated stream with a large volume of water, which are repeated alternately. On the other hand, a pulsating shower stream as in the present embodiment cannot be obtained in a shower apparatus F2 which introduces no air (see FIG. 10A), or in a shower apparatus F3 which introduces air but does not create a shower stream in a pulsating manner (see FIG. 10B).

As described above, the shower apparatus F1 according to the present embodiment is a shower apparatus that discharges aerated bubbly water, and it includes: the water supply unit 41 that supplies water; the throttle unit 42 which is disposed downstream of the water supply unit 41 and which makes the cross sectional area of the flow channel smaller than that in the water supply unit 41, thereby increasing the flow velocity of water passing through the throttle unit 42 to eject the water downstream as a main water stream; the aeration unit 43 which is disposed downstream of the throttle unit 42 and provided with the opening 431 and the air channel 431*a* for aerating the main water stream to produce bubbly water; and the water discharge unit 44 which is disposed downstream of the aeration unit 43 and provided with a plurality of nozzle holes 443 for discharging the bubbly water.

The shower apparatus F1 includes, as a side-water-stream producing unit for producing a side water stream traveling in a direction different from that of the main water stream, the slope 421C for directing the traveling direction of the main water stream toward the air channel 431*a* and the swirl chamber 432 that promotes the formation of the side water stream. By changing the traveling direction of the main water stream periodically by the effect of the side water stream, the shower apparatus F1 changes the volume of air mixed into the main water stream in the aeration unit 43.

According to the present embodiment described above, since the aeration unit 43 aerates the main water stream ejected from the throttle unit 42 to produce bubbly water and the obtained bubbly water is discharged from the water discharge unit 44, the user can enjoy a shower stream with a voluminous feel. Furthermore, since the shower apparatus is provided with the side-water-stream producing unit which produces a side water stream traveling in a direction different from that of the main water stream and the traveling direction of the main water stream is periodically changed by the effect of the side water stream (see FIG. 9), the volume of air mixed into the main water stream in the aeration unit 43 can be changed (see FIG. 10). With this change in volume of the mixed air, the instantaneous flow rate of the bubbly water discharged from the water discharge unit varies greatly, which makes the water stream hitting the user include a strong stream and a weak stream. When the ratio of the mixed air is low, the instantaneous flow rate of the bubbly water is high and the user thus feels as if he/she has been hit by a strong water stream; whereas, when the ratio of the mixed air is high, the instantaneous flow rate of the bubbly water is low and the user thus feels as if he/she has been hit by a weak water stream.

In the present embodiment, a shower stream with a pulsating stimulus as described above is obtained by producing a side water stream in such a manner as to periodically change the traveling direction of the main water stream. In other words, the shower apparatus F1 can give the user a comfortable stimulus in a simple configuration, without a separately installed means, such as a pump for changing the pressure of the shower stream in a pulsating manner.

In the present embodiment, the side-water-stream producing unit produces the side water stream such that side-water-stream negative pressure is generated in the vicinity of the main water stream.

When changing the traveling direction of the main water stream by using the side water stream, a simple and reliable way is to create a variation in pressure arising from the side water stream in the vicinity of the main water stream. In the present embodiment, the bubbly water is produced by taking in air through the opening 431 and the air channel 431*a* of the aeration unit 43 as described above, and thus, the aeration unit 43 has negative pressure inside. In the preferred aspect of the invention described above, in order not to reduce the negative pressure in the aeration unit 43, the traveling direction of the main water stream is changed periodically by generating side-water-stream negative pressure in the vicinity of the main water stream.

In the present embodiment, the side-water-stream producing unit produces the side water stream by using the main water stream ejected toward the aeration unit 43.

Since the side water stream is produced from the main water stream as described above, the traveling direction of the main water stream can be changed periodically in a simpler configuration without separately providing a particular mechanism for producing the side water stream.

In the present embodiment, the traveling direction of the main water stream is periodically changed by a difference in pressure between the side-water-stream negative pressure and the negative suction pressure which is generated to take in air from the opening 431 to the aeration unit 43, and the side-water-stream producing unit changes the side-water-stream negative pressure by the effect of the side water stream and thereby changes the difference in pressure (see FIGS. 4-8).

When considering merely changing the traveling direction of the main water stream, the only thing required is to generate negative pressure acting in a direction crossing the traveling direction of the main water stream, and it may be possible to change the traveling direction of the main water stream merely by changing the negative suction pressure which is generated when taking in air from the opening 431 to produce the bubbly water. However, when changing the traveling direction of the main water stream by the effect of the negative suction pressure alone, the negative suction pressure may be balanced with the pressure of the main water stream after the change due to the negative suction pressure and this may stop the flow of the main water stream. On the other hand, when changing the traveling direction of the main water stream periodically by the pressure difference between the negative suction pressure and the side-water-stream negative pressure, both the negative suction pressure and the side-water-stream negative pressure act on the main water stream and it is possible to prevent the main water stream from stopping traveling due to the pressure being balanced. Since the traveling direction of the main water stream is changed by a change in the pressure of the side water stream in this way, it is possible to ensure that the traveling direction of the main water stream is periodically changed in a simpler configuration.

In the present embodiment, the side-water-stream producing unit produces the side water stream such that the side-water-stream negative pressure is increased when the negative suction pressure is reduced, and the side-water-stream negative pressure is reduced when the negative suction pressure is increased (see FIG. 8).

By increasing the side-water-stream negative pressure when the negative suction pressure is reduced and reducing the side-water-stream negative pressure when the negative suction pressure is increased, a large force can be applied to the main water stream alternately from the negative suction pressure and from the side-water-stream negative pressure. As a result, changes in the traveling direction of the main water stream can be further ensured.

In the present embodiment, the side-water-stream producing unit has the swirl chamber 432, which serves as a guide for producing the side water stream as a swirled stream.

With the swirl chamber 432 serving as a guide for producing the side water stream, the volume of the swirled side water stream can be increased or decreased depending on the size of the swirl chamber 432. Accordingly, by adjusting the size of the swirl chamber 432 depending on the required magnitude of the side-water-stream negative pressure to be generated by the side water stream, suitable side-water-stream negative pressure can be generated.

In the present embodiment, the swirl chamber 432 is located such that the swirl chamber 432, and the opening 431 and the air channel 431*a*, are on opposite sides of the main water stream and face each other.

By locating the swirl chamber 432, which generates the side-water-stream negative pressure, and the opening 431 and air channel 431*a*, which generate negative suction pressure, to face each other, the side-water-stream negative pressure and the negative suction pressure can be generated on opposite sides of the main water stream, which enables the traveling direction of the main water stream to be periodically changed in a stable manner.

In the present embodiment, the swirl chamber 432 is disposed at an end of the aeration unit 43 close to the throttle unit 42.

The end of the aeration unit 43 close to the throttle unit 42 in the present embodiment indicates the part of the aeration unit 43 closest to the location where the main water stream is ejected, and it is also the part where the flow velocity of the main water stream is fastest. Since the swirl chamber 432 is disposed at the location having the fastest flow velocity of the main water stream, the resulting swirled stream also becomes faster, which enables greater side-water-stream negative pressure to be generated.

In the present embodiment, preferably, the throttle unit 42 ejects the main water stream in a direction which is inclined toward the opening 431 and the air channel 431*a*, and away from the location where the side water stream is produced.

Since the direction of ejecting the main water stream is inclined toward the opening 431 and the air channel 431*a*, the traveling direction of the main water stream ejected from the throttle unit 42 is inclined toward the opening 431 and the air channel 431*a* (see FIGS. 4 and 9). Since a side water stream is produced as a result of the ejection of the main water stream and side-water-stream negative pressure is generated accordingly, the traveling direction of the main water stream which is originally inclined toward the opening 431 and the air channel 431*a* will be changed to instead be inclined toward the side water stream (see FIGS. 5 and 9). By attracting the main water stream, which was originally inclined toward the opening 431 and the air channel 431*a*, to travel in a direction inclined toward the side water stream, the extent of change in the traveling direction of the main water stream can be increased, enabling the volume of the mixed air to be greatly changed. As a result, the user can experience a water stream which changes greatly between strong and weak water streams, and can thus enjoy a strongly pulsating stimulus.

In the present embodiment, the main water stream is produced as a water stream that prevents the air taken in from the opening 431 and the air channel 431*a* from flowing into the side water stream.

Since the main water stream prevents the air taken in from the opening 431 and the air channel 431*a* from flowing into the side water stream, the side water stream can be produced in a more stable manner and the side-water-stream negative pressure can accordingly be generated in a more stable manner.

Embodiments of the present invention have been described above with reference to concrete examples. However, the present invention is not limited to these examples. That is, when those skilled in the art make design changes to any of the examples, the resulting variations are also included in the scope of the present invention as long as the variations contain the features of the present invention. For example, the components of the above-described examples as well as the arrangements, materials, conditions, shapes, sizes, and the like of the components are not limited to those illustrated above, and may be changed as required. Also, the components of the above-described embodiments may be combined as long as it is technically possible, and the resulting combinations are also included in the scope of the present invention as long as the combinations contain the features of the present invention.

What is claimed is:

1. A shower apparatus that discharges aerated bubbly water, comprising:

a water supply unit that supplies water;

a throttle unit disposed downstream of the water supply unit, the throttle unit making a cross sectional area of a flow channel smaller than that of the water supply unit and thereby increasing a flow velocity of water passing through the throttle unit to eject the water downstream as a main water stream;

an aeration unit disposed downstream of the throttle unit and provided with an opening for aerating the main water stream to produce bubbly water;

a water discharge unit disposed downstream of the aeration unit and provided with a plurality of nozzle holes for discharging the bubbly water; and a side-water-stream producing unit that produces a side water stream traveling in a direction different from that of the main water stream, wherein the traveling direction of the main water stream is changed periodically by the effect of the side water stream, so as to change a volume of air mixed into the main water stream in the aeration unit, the side-water-stream producing unit has a swirl chamber located such that the swirl chamber and the opening are on opposite sides of the main water stream, the swirl chamber is formed as a concave portion for producing the side water stream as a swirled stream that generates negative pressure to attract the main water stream, and the throttle unit is configured to eject the main water stream between the opening and the swirl chamber such that the main water stream prevents the air taken in from the opening from flowing into the side water stream.

2. The shower apparatus according to claim 1, wherein the side-water-stream producing unit produces the side water stream such that side-water-stream negative pressure is generated in the vicinity of the main water stream.

3. The shower apparatus according to claim 2, wherein the traveling direction of the main water stream is periodically changed by a difference in pressure between the side-water-stream negative pressure and negative suction pressure which is generated to take in air from the opening to the aeration unit, and wherein the side-water-stream producing unit changes the side-water-stream negative pressure by the effect of the side water stream, thereby changing the difference in pressure.

4. The shower apparatus according to claim 3, wherein the side-water-stream producing unit produces the side water stream such that the side-water-stream negative pressure is increased when the negative suction pressure is reduced and the side-water-stream negative pressure is reduced when the negative suction pressure is increased.

5. The shower apparatus according to claim 4, wherein the side-water-stream producing unit produces the side water stream using the main water stream ejected toward the aeration unit.

6. The shower apparatus according to claim 5, wherein the swirl chamber is disposed at an end of the aeration unit close to the throttle unit.

7. The shower apparatus according to claim 5, wherein the throttle unit ejects the main water stream in a direction which is inclined toward the opening and away from the location where the side water stream is produced.

* * * * *